United States Patent [19]

Eysn et al.

[11] 4,239,193

[45] Dec. 16, 1980

[54] CONVERTER BOTTOM FASTENING ARRANGEMENT

[75] Inventors: Manfred Eysn, Linz, Austria; Daniel Meyer, Neuves Maisons, France

[73] Assignees: Voest-Alpine Aktiengesellschaft, Austria; Société Sidérurgique Châtillon Neuves Maisons, France

[21] Appl. No.: 22,824

[22] Filed: Mar. 22, 1979

[30] Foreign Application Priority Data

Apr. 5, 1978 [AT] Austria ..... 2382/78

[51] Int. Cl.[3] ..... C21C 5/42

[52] U.S. Cl. ..... 266/243

[58] Field of Search ..... 266/224, 243

[56] References Cited

U.S. PATENT DOCUMENTS

| | | | |
|---|---|---|---|
| 3,851,865 | 12/1974 | Fisher | 266/224 |
| 4,022,445 | 5/1977 | Langenfeld | 266/224 |
| 4,128,233 | 12/1978 | Eysn | 266/243 |

*Primary Examiner*—P. D. Rosenberg
*Attorney, Agent, or Firm*—Brumbaugh, Graves, Donohue & Raymond

[57] ABSTRACT

A converter bottom fastening arrangement to be used in a converter construction with a removable converter bottom fastened to the converter jacket, or a supporting construction connected therewith, includes a plurality of peripherally arranged rocker-shaped clamping levers which are displaceable into and out of an engagement position with the converter bottom. The outer ends of the levers facing the converter jacket are supported with respect to the converter jacket or the supporting construction by means of bracing devices. Guide elements are provided on the bracing devices and a curved guideway is provided on the converter by which the bracing devices are guided between a vertical bracing position and a released position along the curved guideway.

8 Claims, 4 Drawing Figures

CONVERTER BOTTOM FASTENING ARRANGEMENT

BACKGROUND OF THE INVENTION

The invention relates to a converter having a removable bottom fastened to the converter jacket and/or to a supporting construction connected therewith, by means of a plurality of peripherally arranged rocker-shaped clamping levers that are displaceable into and out of the engagement position with the bottom.

In order to be able with this construction to fasten the bottom with means that need only a little free space, and in order to take into account deviations in the shape of the bottom, it was suggested, according to a proposal not yet belonging to the prior art, that the ends of the clamping levers facing the converter jacket be supported against the converter jacket and/or the supporting construction by bracing means, in particular bracing screws.

However, since the working conditions in the region of the converter bottom are unfavorable on account of poor accessibility, heat, dust, etc., there have been efforts to reduce to a minimum the manipulations necessary for loosening and fastening the converter bottom and the force necessary therefor.

SUMMARY OF THE INVENTION

The invention relates to an improvement and further development of the above-mentioned construction in which a longitudinal displacement of the clamping lever is effected with little necessary force by using the bracing means both for bracing and for releasing the clamping lever from the holding position.

This object is achieved according to the invention in that a curved guideway and a guide element are provided for the bracing means. In particular a guide pin is located on the bracing means, by which pin the bracing means is guided from the vertical bracing position into a released position along the curved guideway.

According to a preferred embodiment, the bracing means, in the form of a bracing screw that is articulately connected with the clamping lever, is braceable against an abutment by means of a nut. The abutment comprises the guide pin which engages in the guideway that is formed as an arcuate wing. After loosening of the nut, the bracing screw is pivotable into the released position and vice versa.

Suitably, the guideway is provided with a stopper for restricting the pivoting movement of the bracing screw.

Advantageously, also the longitudinal movement of the bracing screw is restricted by a stopper.

BRIEF DESCRIPTION OF THE DRAWINGS

A preferred embodiment of the invention is illustrated in the drawings, wherein.

DESCRIPTION OF A PREFERRED EMBODIMENT

Figure 1:
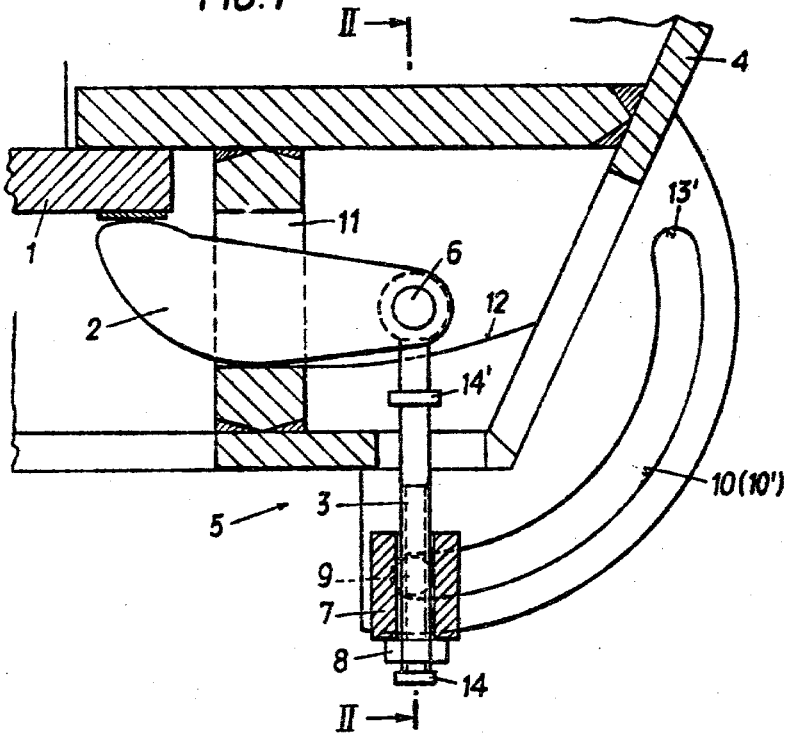
FIG. 1 shows the fastening mechanism for the converter bottom in the bracing position.

A converter bottom 1 is fastened by clamping levers 2 and bracing screws 3 on a supporting construction 5 fastened to a converter jacket 4. The bracing screw 3 is articulately connected with the clamping lever 2 by an articulation pin 6 and is guided with play with its threaded shaft through an abutment 7. The bracing screw is braceable against the abutment 7 by a nut 8. Guide pins 9, 9' are provided on both sides of the abutment 7, which guide pins are slidable in the slot or wing guides 10, 10' that are fastened to the supporting construction 5.

Figure 2:
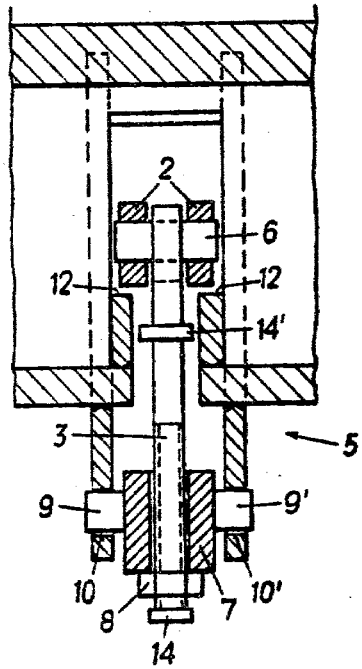
FIG. 2 is a section along line II—II of FIG. 1.
Figure 3:
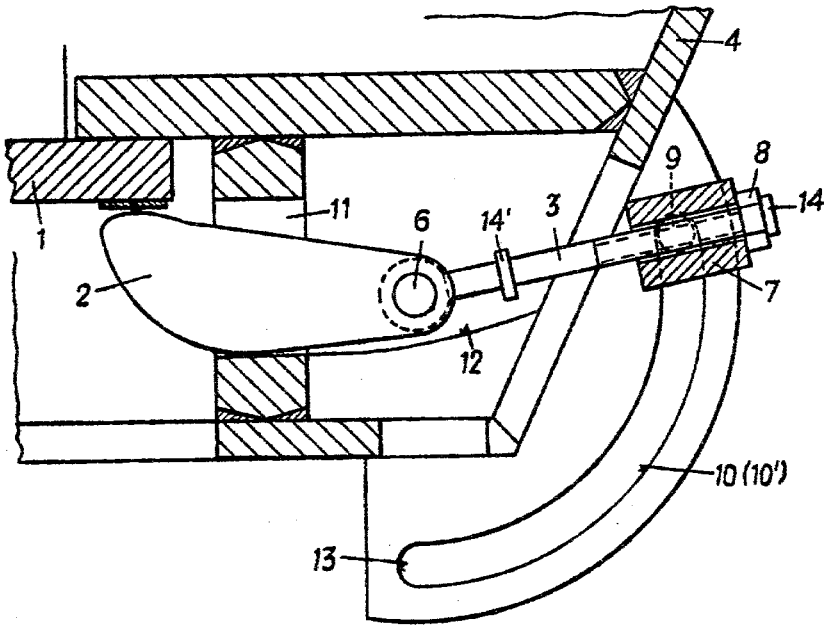
FIGS. 3 and 4 illustrate consecutive positions of the bracing screw and the clamping lever in the released position.

In FIGS. 1 and 2, the bracing nut 8 is tightened relative to the abutment 7, the bracing screw 3 is in the vertical position and the front end of the clamping lever 2 is contacting the converter bottom 1. For loosening the converter bottom, the nut 8 is loosened, the clamping lever 2 thus being relieved. Then the bracing screw 3 can be pivoted into the first release position illustrated in FIG. 3, the pins 9, 9' being guided in the curved guideway slots of wing guides 10, 10'.

Figure 4:
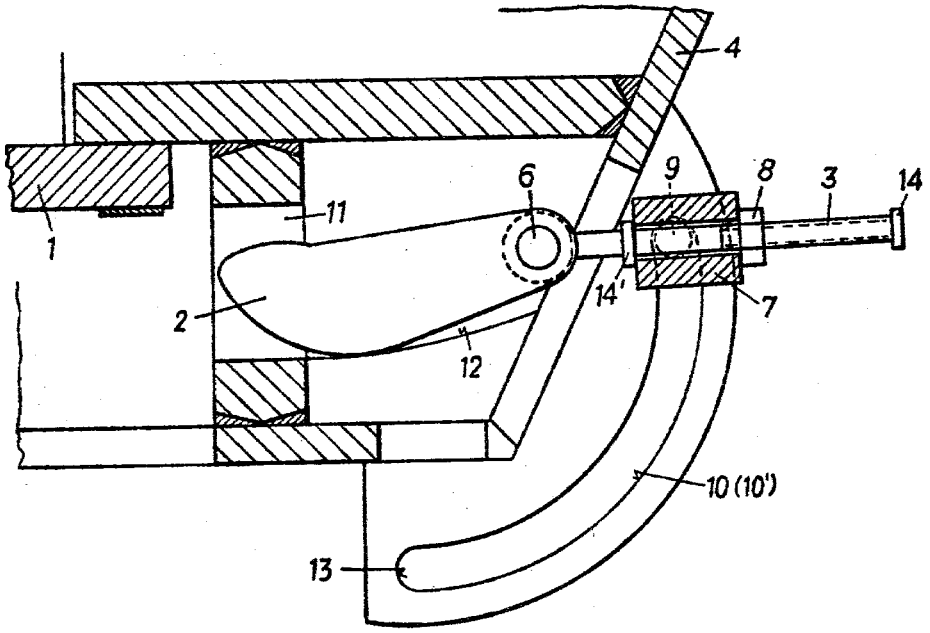

In FIG. 4 the second release position is shown, in which the clamping lever 2 is drawn out of the opening 11 provided in the supporting construction 5 by tightening of the nut 8, the lower side of the clamping lever 2 sliding on a slide face 12.

The installation and fastening of the converter bottom 1 is effected in the reverse order. Suitably, the slot guide is provided with stoppers 13, 13' for restricting the pivoting movement. In order to be able to quickly adjust the right positions of the clamping lever, the bracing screw can also be provided with stoppers 14, 14' for restricting its longitudinal movement.

The converter bottom fastening arrangement illustrated can be modified in various ways; thus, for instance, it would be possible to design the articulation pin 6 as a guide pin, instead of the guide pins 9, 9', and to guide it in a guideway provided at the supporting construction 5.

What we claim is:

1. In a converter bottom fastening arrangement to be used in a converter construction comprising:

a removable converter bottom;

a converter jacket defining a bottom opening to be covered by said removable converter bottom;

a supporting construction connected to said converter jacket;

a plurality of rocker-shaped clamping levers peripherally arranged about said removable converter bottom for securing said removable converter bottom to said converter construction, said plurality of rocker-shaped clamping levers being displaceable into and out of an engagement position with said removable converter bottom and having outer ends facing said converter jacket; and bracing means being provided for supporting said outer ends with respect to said converter construction, the improvement which is characterized in that a curved guideway is provided and guide means are provided on said bracing means, said bracing means being guided by said guide means along the curved guideway between a vertical bracing position and a released position.

2. An arrangement as set forth in claim 1, wherein said plurality of rocker-shaped clamping levers secure said removable converter bottom to said supporting construction, said bracing means supporting said outer ends of said plurality of rocker-shaped clamping levers with respect to said supporting construction.

3. An arrangement as set forth in claim 1, wherein said bracing means are bracing screws.

4. An arrangement as set forth in claim 1, wherein said guide means are guide pins.

5. An arrangement as set forth in claim 1, wherein said bracing means are bracing screws articulately connected to said outer ends of said clamping levers, abutments are positioned on said bracing screws and nuts are located on said abutments to engage said bracing screws, each of said bracing screws being braceable against its pertaining abutment by its pertaining nut, said curved guideway is formed by arcuate wings, said guide means are designed as guide pins provided on said abutments and engaging in said arcuate wings, and said bracing screws are pivotable into said released position and vice versa, after loosening of said nuts.

6. An arrangement as set forth in claim 5, further comprising stopper means provided on said curved guideway for restricting pivoting movements of said bracing screws.

7. An arrangement as set forth in claim 5, further comprising stopper means for restricting longitudinal movements of said bracing screws.

8. An arrangement as set forth in claim 6, further comprising stopper means for restricting longitudinal movements of said bracing screws.

* * * * *